United States Patent [19]

Limper

[11] 4,019,083

[45] * Apr. 19, 1977

[54] TELEVISION CAMERA TUBE

[75] Inventor: Nicolaas Hendrik Limper, Eindhoven, Netherlands

[73] Assignee: U.S. Philips Corporation, New York, N.Y.

[ * ] Notice: The portion of the term of this patent subsequent to Aug. 31, 1993, has been disclaimed.

[22] Filed: Sept. 17, 1975

[21] Appl. No.: 614,254

[30] Foreign Application Priority Data

Sept. 19, 1974 Netherlands ..... 7412382

[52] U.S. Cl. ..... 313/372; 313/384

[51] Int. Cl.[2] ..... H01J 31/26; H01J 31/38

[58] Field of Search ..... 317/371, 372, 384

[56] References Cited

UNITED STATES PATENTS

| | | | |
|---|---|---|---|
| 3,628,076 | 12/1971 | Weijland et al. | 313/372 X |
| 3,925,699 | 12/1975 | Banks et al. | 313/384 |
| 3,978,365 | 8/1976 | Limper | 313/372 |

*Primary Examiner*—Robert Segal

*Attorney, Agent, or Firm*—Frank R. Trifari; Carl P. Steinhauser

[57] ABSTRACT

A television camera tube having background illumination provided by a light diffuser in a space between the anode sleeve and an auxiliary cylinder which coaxially projects into the anode sleeve and which is constructed and marked, on the side facing the target, such that parts of the target are half-shade areas of the light diffuser and a signal derived from the target is homogeneous across the entire target in the case of an homogeneous target illumination.

10 Claims, 1 Drawing Figure

TELEVISION CAMERA TUBE

Figure 1:
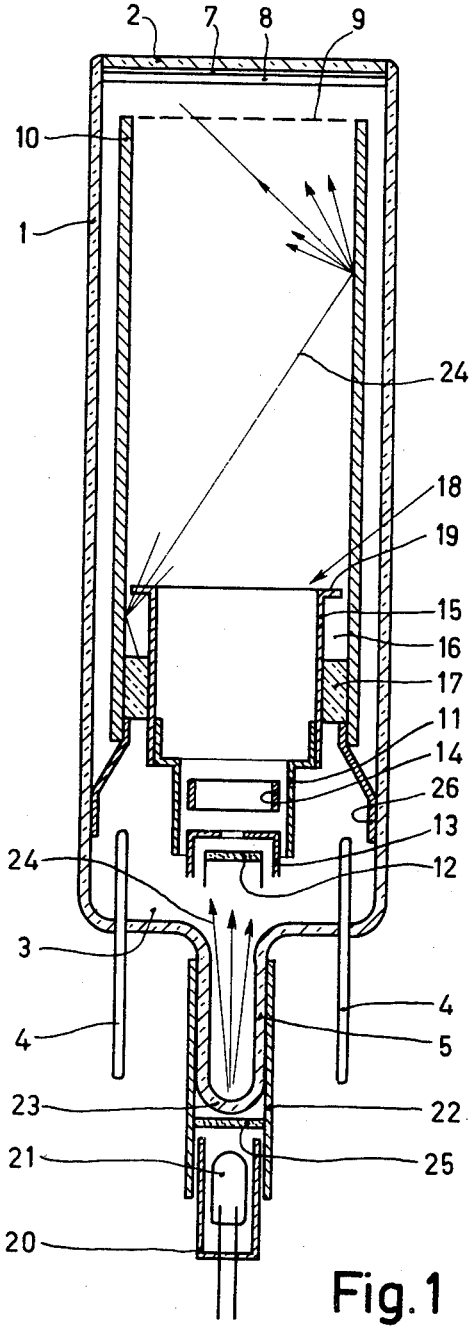

The invention relates to a television camera tube comprising a photo-sensitive target and an auxiliary illumination device comprising a light source and a light diffuser for dispersing auxiliary illumination light intercepted by the light diffuser.

A camera tube of this kind is known, for example, from U.S. Pat. No. 3,751,703. Therein, a camera tube is described wherein a light source is accommodated in the base of the camera tube. One or more light conductors conduct light from the light source into a cylindrical output anode sleeve of the camera tube. The target is more or less uniformly illuminated by making the inner wall of this anode sleeve reflective, preferably diffusely reflective. Considering the increasingly severe requirements imposed as regards the uniformity of the television signal across the entire surface of the target, this solution is not always adequate.

British patent specification No. 1,299,288 describes a camera tube which aims to improve the homogeneity of the auxiliary illumination of the target by introducing the light into the anode sleeve such that it is distributed as uniformly as possible over the circumference of the tube. However, the choice as regards the intensity distribution of the light across the target is still limited. A central portion of the target in television camera tubes of the relevant type usually has a higher sensitivity than portions situated nearer to the edge. Therefore, it may be desirable for the intensity distribution of the light across the target not to be homogeneous, but to compensate for the higher sensitivity of the central portion with respect to the edge portions by applying less auxiliary light to the central portion. A solution in this respect is described in application Ser. No. 566,535 filed April 8, 1975. However, the light conductor described therein implies a more complex construction of the tube.

The invention has for its object to provide a television camera tube having auxiliary illumination with an intensity distribution such that in the case of a uniform image illumination of the target a television signal is obtained which is uniform within narrow limits across the entire target. To this end, a television camera tube of the kind set forth according to the invention is characterized in that the light diffuser is accommodated in a space between the anode sleeve and a hollow auxiliary cylinder which coaxially projects into the anode sleeve as far as beyond the light diffuser, measured in the direction of the target.

In a camera tube according to the invention an extremely homogeneous target illumination as well as a target illumination with a predetermined nonuniform intensity distribution can be achieved by adaptation of the length and the finish of the auxiliary cylinder and possible adaptation of the light diffuser. The inhomogeneity in the sensitivity of the target can thus be compensated for in a simple manner. Furthermore, by profiling the boundary of the auxiliary cylinder facing the target, by making openings in the cylinder wall or by providing a flange on the auxiliary cylinder, given portions of the target can be less or more illuminated relative to each other. A local variation of the light intensity can also be realized by making the transmission of the light diffusor to be locally different.

The light diffuser in a preferred embodiment consists of a matted light-transmitting ring or a ring of a diffusely transparent material which is mounted between the two sleeves with a suitable fit.

A few preferred embodiments of the device according to the invention will be described in detail hereinafter with reference to the drawing.

FIG. 1 is a diagrammatic sectional view of a camera tube according to the invention.

As is shown in FIG. 1, a television camera tube of the Vidicon type comprises a glass envelope 1 having an entrance window 2 and a tube base 3 with passage pins 4 and a pumping stem 5. The window 2 is provided on the inner side with a target which comprises a transparent signal electrode 7 and a photo-sensitive layer 8. The photo-sensitive layer preferably consists of lead monoxide, but can alternatively be composed of another photo-conductive material. A gauze electrode 9 is mounted in the tube at a comparatively small distance from the target. This gauze electrode can be arranged on an end of the anode sleeve 10, but can alternatively be arranged to be electrically insulated therefrom. An electron gun 11 is arranged on an end of the anode sleeve 10 which is remote from the target. This electron gun comprises a cathode 12, a control grid 13 and preferably one or a few control anodes 14. An auxiliary cylinder 15 is at least partly coaxially mounted in the anode sleeve 10. The diameter of the portion of the cylinder 15 which projects into the anode sleeve has a diameter such that an annular space 16 remains between this cylinder and the anode sleeve. The space 16 accommodates a light diffuser 17 which is in this case shaped as a ring and which closes off the space 16 for direct light passage. The auxiliary cylinder 15 projects well beyond the light diffuser in the anode sleeve so far that, when the light diffuser is struck by light, half-shade areas occur on the target. In a preferred embodiment, the distance between the boundary of the light diffuser facing the target and the boundary of the auxiliary cylinder facing the target is so large that a central portion of the target is also situated within this half-shade area. A boundary 18 of the auxiliary cylinder 15 can be adapted to a desired light distribution on the target empirically as well as by calculations. For example, the length of the auxiliary cylinder can be chosen to be such that the center of the target is just not directly exposed to light from the diffuser. By profiling the boundary 18 or by providing openings in the cylinder wall, given areas of the target plate can be more or less favoured. To this end, in a further preferred embodiment a flange 19 is arranged on the end 18 of the auxiliary cylinder facing the target. This flange partly closes off the space 16 and can be provided with openings or cutouts. The profiling of the boundary 18 of the auxiliary cylinder 15, the provision of openings in the wall thereof and the provision and machining of the flange can be readily performed, because only thin-walled material is involved. The auxiliary cylinder does not perform an active function in the electron-optical system of the camera tube, so that no image errors can be introduced thereby. Preferably, at least the inner side of the anode sleeve 10 is made to be diffusely reflective so as to prevent the occurrence of given preferred orientations and hence extra illuminated target areas. In practical embodiments, the anode sleeve as well as the auxiliary cylinder has a circular cross-section, but this is not necessary for proper operation of a camera tube according to the invention.

In addition to ample adjustability of the light distribution on the target by adaptation of the finish and the position of the auxiliary cylinder, different light intensity distributions can also be realized by making the degree of light transparency of the light diffuser locally different. For example, a pattern of black strips or a continuous or stepwise varying blackening can be provided on the light diffuser. The light diffuser preferably consists of matted, transparent material, it being possible for the jacket faces to be polished so as to limit the loss of light. However, the light diffuser can also be composed of diffusely transparent material. A small degree of homogeneity can occur in the light distribution across the target in a camera tube as described above, in that too much light is incident on the edge of the target. The anode sleeve 10 in a preferred embodiment is provided with a broadened portion near the target, so that this relative overexposure is avoided. In a further preferred embodiment according to the invention, the last portion of the anode sleeve which faces the target is made to be less reflective on the inner side. A light source 21 which is accommodated in the holder 20 is arranged in a housing 22 which is arranged about the pumping stem 5 of the camera tube in the embodiment shown. So as to ensure easy connection of the camera tube to a tube base holder, the pumping stem is constructed to be extra narrow. The housing 22 can also be arranged against the pump stem which can then possibly be thicker, and is secured thereto, for example, by means of cement. A portion 23 of the pumping stem 5 can then be formed such that a given lens action is obtained for the light emitted by the light source. In order to limit the wavelength range of the light 24 to be used, a filter 25 can be mounted between the light source and the pumping stem. In order to limit the loss of light and undesired stray light in the camera tube, a light screen 26 is provided between the anode sleeve and the tube wall in the preferred embodiment shown. This light screen is shaped, for example, as a cone which encloses an angle of maximum approximately 45° with the tube wall. At least the inner face of the said screen is preferably made to be reflective. The inner walls of the housing 22 and the holders 20 are also preferably made to be reflective. By choosing a suitable diffraction index for the cement whereby the housing 22 is secured to the pumping stem, loss of light can again be limited. The light source can be readily exchanged in this preferred embodiment, if necessary. The camera tube then remains completely undamaged. In the pumping stem of a further preferred embodiment of the device according to an invention an indentation is provided which projects into the camera tube. A light source can be arranged in this indentation, thus occupying a comparatively favourable position for the useful light yield of the auxiliary illumination.

What is claimed is:

1. A television camera tube having, in an evacuated envelope, a photosensitive target, an electron gun assembly, an anode sleeve extending between the target and the gun assembly, and means for the auxiliary illumination of the target, said auxiliary illuminating means comprising a light source, a hollow light shielding cylinder located within said anode sleeve to define an annular space between its outer wall and an inner wall portion of said sleeve, an annular light distributor disposed within said annular space, said shielding cylinder coaxially extending within said anode sleeve in a direction toward said target a distance which produces a substantially uniform illumination of said target and a television signal is obtained which is uniform within narrow limits across said target, and means for conducting light from said light source to the distributor in the annular space section remote from said target.

2. A television camera tube as claimed in claim 1, wherein the light conductor is a diffusely transparent material.

3. A television camera tube as claimed in claim 2, wherein the auxiliary cylinder has a profiled boundary on the side facing the target.

4. A television camera tube as claimed in claim 3, wherein the auxiliary cylinder has openings which are situated near the light diffuser.

5. A television camera tube as claimed in claim 4 wherein a flange is provided on the side facing the target which partly closes off the space between the anode sleeve and the auxiliary cylinder sleeve.

6. A television camera tube as claimed in claim 5 wherein the auxiliary cylinder is constructed to shield the center of the target from direct exposure to light from the light diffuser.

7. A television camera tube as claimed in claim 6 wherein a portion of the anode sleeve which faces the target has an inner wall portion of lower reflectivity.

8. A television camera tube as claimed in claim 7 including a tapered light screen between the end of the anode sleeve facing the tube base and the tube wall.

9. A television camera tube as claimed in claim 8 wherein the light source is accommodated in a housing which is mounted on the pumping stem of the camera tube.

10. A television camera tube as claimed in claim 9 wherein the camera tube has an identation at the area of the pumping stem for accommodating the auxiliary illumination light source.

* * * * *